United States Patent [19]

Nakagiri et al.

[11] 4,173,862

[45] Nov. 13, 1979

[54] BOOSTER CIRCUIT FOR ELECTRONIC TIMEPIECE

[76] Inventors: Tadahiko Nakagiri, Higashimurayama; Kunihiro Daigo, Higashiyamato; Toshiaki Oguchi, Kodaira; Toshikazu Hatuse; Toshikazu Shimazaki, both of Tanashi; Shigeru Morokawa, Higashiyamato; Minoru Natori, Tokyo; Hiroshi Ogawa, Tokorozawa, all of Japan

[21] Appl. No.: 800,251

[22] Filed: May 25, 1977

[30] Foreign Application Priority Data

Jun. 1, 1976 [JP] Japan ..... 51/63831
Jun. 9, 1976 [JP] Japan ..... 51/66449

[51] Int. Cl.[2] ..... G04C 3/00
[52] U.S. Cl. ..... 58/23 BA; 58/23 AC
[58] Field of Search ..... 58/23 R, 23 A, 23 BA, 58/23 AC, 50 R, 152 R

[56] References Cited

U.S. PATENT DOCUMENTS

| | | | |
|---|---|---|---|
| 3,818,484 | 6/1974 | Nakamura et al. | 58/23 BA X |
| 3,955,353 | 5/1976 | Astle | 58/23 BA |
| 3,958,187 | 5/1976 | Suzuki et al. | 58/23 A X |
| 4,041,295 | 8/1977 | Ido et al. | 58/50 R X |
| 4,068,295 | 1/1978 | Portmann | 58/23 BA X |

*Primary Examiner*—Stanley J. Witkowski

[57] ABSTRACT

A booster circuit for an electronic timepiece having a power supply and a display device adapted to be driven in a matrix driving mode, which comprises a Cockcroft circuit connected to one terminal of the power supply to provide a plurality of boosted output voltages to the display device and voltage compensating means connected to the other terminal of the power supply to compensate for voltage drops caused by said Cockcroft circuit.

4 Claims, 10 Drawing Figures

V0
V1
V2
V3
V4

38
46
44
42
48
R1
C0
40
V6
C7
V0
36
36a
36b
62
64
80-3
V1
C1
50
52
V2
C2
C3
54
56
V3
C4
58
C5
60
V4
C6
30
DISPLAY DEVICE

BOOSTER CIRCUIT FOR ELECTRONIC TIMEPIECE

This invention relates to electronic timepieces having display devices driven in matrix mode and, more particularly, to a booster circuit for such timepieces.

In recent years, much progress has been made in the development of wristwatches which display time in a digital manner through the utilization of electro-optical display devices such as liquid crystals, LEDs, or electro-chromic substances. In addition, the growth of IC technology has made it possible to realize extremely slender, multifunction wristwatches which have a sufficiently long battery life. For example, digital wristwatches of the crystal controlled oscillator type utilizing liquid crystal display elements have already been developed and normally can be expected to operate for two years on a single battery. Progress in the field of ICs has also promoted the development of electronic calculators and they too have been greatly reduced in size, furnished with a number of functions and have come to make use of such low power display devices as liquid crystals. It has heretofore been proposed to combine and accommodate within the same wristwatch case an electronic calculator as well as a digital timepiece. This type of wristwatch will be referred to as an electronic calculator wristwatch hereinafter. The electronic calculator wristwatch which make use of liquid display devices are characterized by the fact that they consume little power. This is especially true with regard to the time-keeping section of a wristwatch which demands little voltage and power, a feature that assures a power source lifetime of approximately two years. However, the stability of calculation circuits and the speed required for calculations in the calculator section of a wristwatch demand a higher voltage and necessitate a greater consumption of power than the time-keeping section. Moreover, unlike the time-keeping section which employs a static method of driving, the electronic calculator section makes use of a matrix driving method since the number of terminal leads for the display device are reduced to as great an extent as possible. A matrix driving method requires at least two power sources which, because of the limited space within the watch case, cannot be connected in series.

In addition, a problem has been encountered in the electronic calculator watch wherein the liquid crystal display device for the calculator section is driven in a matrix driving mode in that a matrix drive signal has an unbalanced voltage potential with respect to the reference voltage, causing deterioration of the liquid crystal and wasteful power consumption.

It is therefore an object of the present invention to provide an improved booster circuit for an electronic timepiece having a display device adapted to be driven in a matrix driving mode.

It is another object of the present invention to provide an improved booster circuit for an electronic timepiece having a display device adapted to be driven in a matrix driving mode, which booster circuit makes it possible to reduce power consumption and prevent deterioration of the liquid crystal.

It is a further object of the present invention to provide an improved booster circuit for an electronic timepiece, which booster circuit is simple in construction and reliable in operation.

Figure 1:
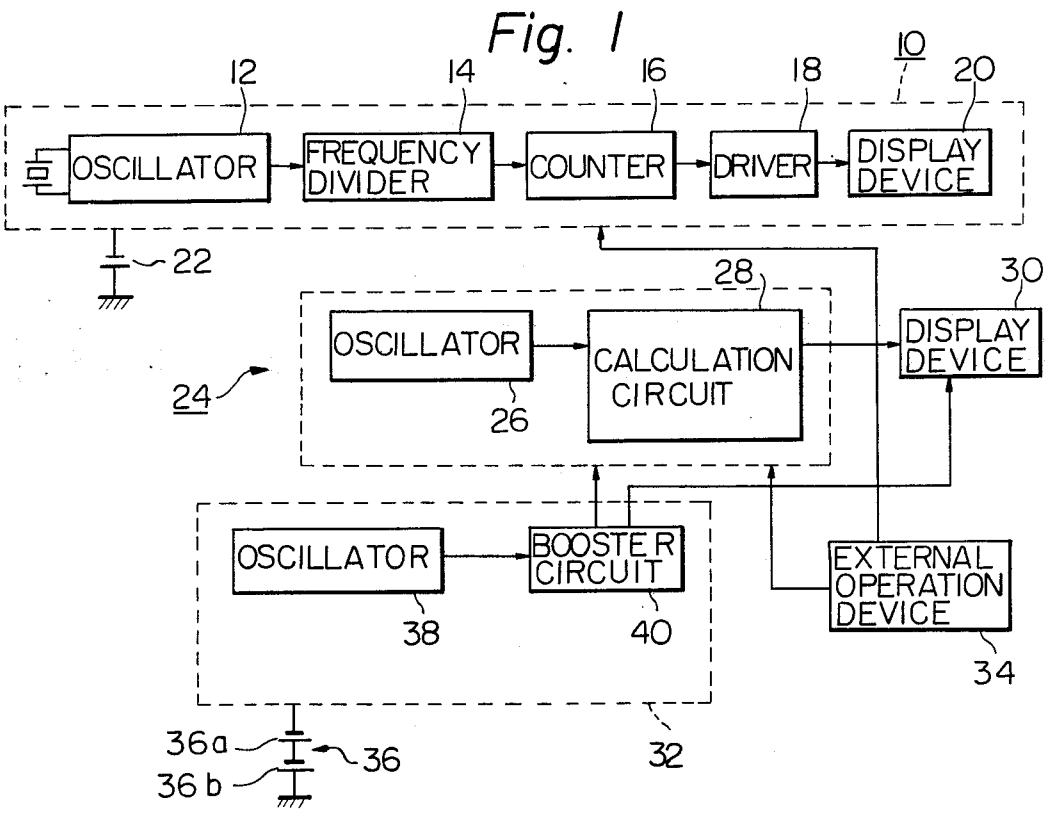
FIG. 1 is a block diagram of an electronic calculator watch incorporating a preferred embodiment of a booster circuit according to the present invention.

FIG. 1 is a block diagram of an electronic calculator wristwatch incorporating a booster circuit in accordance with the present invention. Reference numeral 10 denotes a timekeeping section and includes an oscillator 12 providing a high frequency signal, frequency divider 14 connected to the oscillator 12 to divide down the high frequency signal to provide a low frequency signal, counter 16 responsive to the low frequency signal to provide output signals of various time data, driver 18 responsive to the output signals to provide drive signals, display device 20 responsive to the drive signals to display time, and power supply 22 composed of a single battery connected to the timekeeping section 10. Electronic calculator section 24 includes an oscillator 26 providing clock signals for calculations, a calculation circuit 28 connected to the oscillator 26, display device 30 the digit and segment electrodes of which are arranged in a matrix configuration to display output data from the calculation circuit 28, power source 32 and an external operation device or keyboard 34 composed of numeric and function keys. Power source 32 is composed of a battery 36 made up of two batteries **36*a*, 36*b*, and also includes an oscillator 38 for boosting voltage, and booster circuit 40 connected to the calculation circuit 28 and the display device 30** to supply booster voltages thereto.

Figures 2A, 2B:
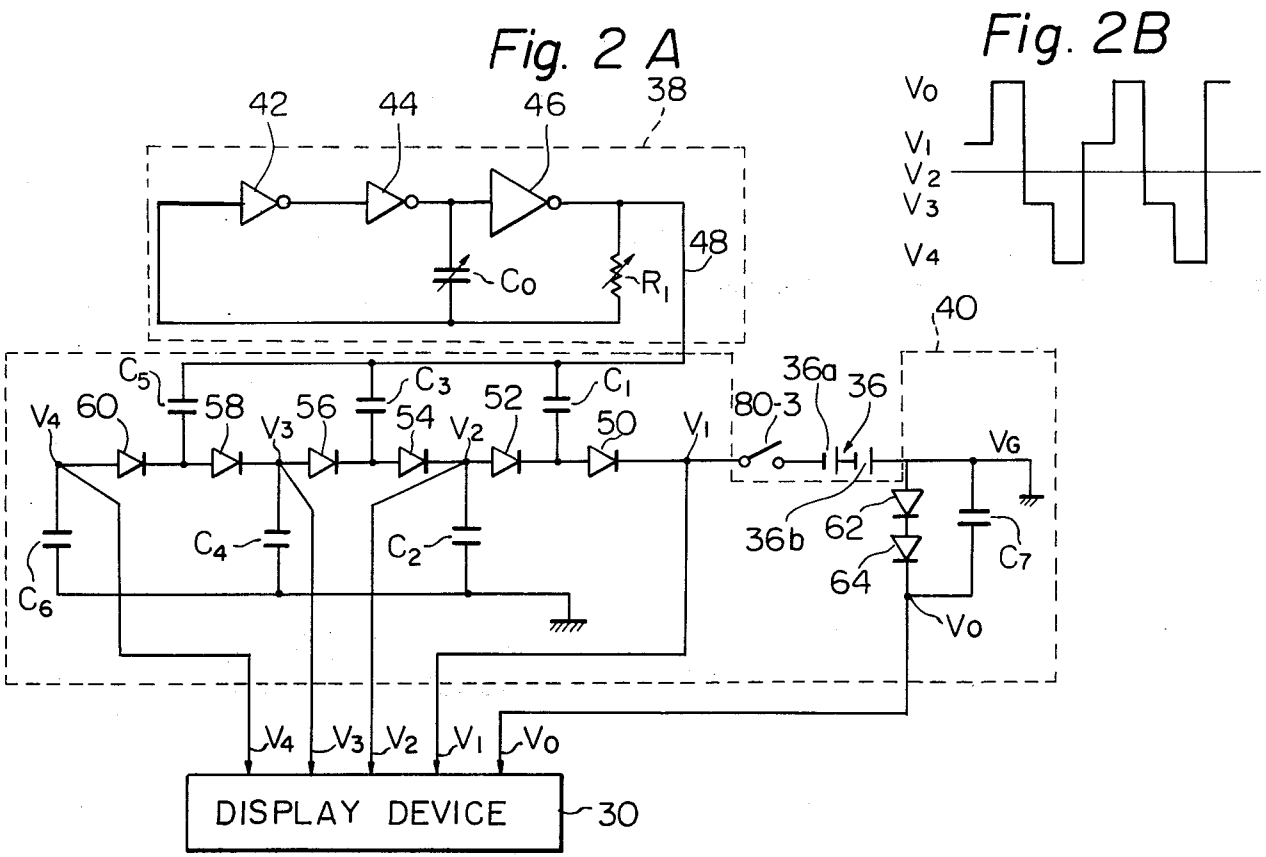
FIG. 2A is a detailed electric circuitry of the booster circuit shown in FIG. 1.
FIG. 2B is an example of a matrix drive signal having voltage potentials provided by the booster circuit of FIG. 2A.

FIG. 2A is a preferred embodiment of a booster circuit employed in the power source 32 which supplies power to the calculator of the wristwatch in accordance with the invention with the booster circuit converting a battery voltage potential to a plurality of different voltage levels. Oscillator 38 includes inverting amplifiers 42, 44 and 46 connected in series, and variable capacitor $C_0$ and variable resistor $R_1$ connected in parallel with the inverting amplifiers 44 and 46 to regulate the output oscillating frequency for thereby adjusting the output voltage of the booster circuit 40. With this arrangement, the oscillator 38 applies an AC current to booster circuit 40. An approximately 300 Hz clock or input signal produced by the oscillator is amplified and shaped by the inverters 42, 44, inverted by the inverter 46 and appears as a rectangular wave output signal on output line 48 which applies the signal to booster circuit 40. The inverting amplifiers 42, 44, 46 are of C-MOS (complementary metal oxide semiconductor) type and, by shaping the rectangular wave, reduce by as much as possible the electrical power which flows through the circuit during the switching of the output inverting amplifier 46. Furthermore, when the threshold voltage Vth of the C-MOS transistor of inverter-amplifier 46 is set close to the power source voltage, the current flow is reduced to a very low level during the switching of the C-MOS transistor even if the input to the inverter has a sine wave component. Therefore, there will be almost no wasteful consumption of power within inverter-amplifier 46 if the threshold voltage of the inverter amplifier is set to at least to a value between 80% of the power source voltage and the power source voltage itselt. Accordingly, if oscillator 38 makes use of an independent C-MOS chip which is provided independently from the IC chip of the calculator, and if a threshold voltage Vth set close to the voltage of power supply 36 is employed, power consumption can be reduced in a manner as previously noted.

The booster circuit 40 includes a Cockcroft circuit connected to the negative terminal of power supply 36 and composed of a plurality of pairs of booster diodes 50 through 60 connected in series and capacitors C1 through C6 connected in parallel with the diodes 50 through 60, respectively, in order to provide a plurality of output voltages V1, V2, V3 and V4 in response to clock pulses. Assuming that the output voltage of the power supply 36 is 3 V, the voltages V1, V2, V3 and V4 have potential levels of −3 V, −4.6 V, −6.3 V and −8.3 V, respectively. The voltages V0, V1, V2, V3 and V4 are applied to a display driver (not shown) of the display device 30, which is driven in a matrix driving mode. A typical example of a drive signal employed in the matrix driving mode is shown in FIG. 2B. Now, assuming that the voltage V2 is a reference voltage, the potential difference between the voltage V2 and each of the voltages VG, V1, V3 and V4 is expressed as:

| | | | | | |
|---|---|---|---|---|---|
| \| V3 | − V2 \| | = | \| 6.3 | − 4.6 | \| = 1.7 |
| \| V4 | − V2 \| | = | \| 8.3 | − 4.6 | \| = 3.7 |
| \| V1 | − V2 \| | = | \| 4.6 | − 3 | \| = 1.6 |
| \| VG | − V2 \| | = | \| 0 | − 4.6 | \| = 4.6 |

From the above equations it will be seen that there exists a significant difference in potential level between the absolute value of V4−V2 and that of VG−V2. This potential difference will cause a DC component in the matrix driving, so that deterioration of liquid crystals will be caused. To prevent this drawback, the present invention features the provision of voltage compensating elements such as diodes 62 and 64 connected in series with the positive terminal of the power supply 36. The diodes 62 and 64 serve as voltage dropping diodes but may be replaced by resistors or by other semi-conductors such as transistors or thermistors serving to compensate for changes in ambient temperature. A capacitor C7 is connected in parallel with the diodes 62 and 64; the voltage across the capacitor C7 is designated by V0. The voltage drop which occurs across each of the diodes 62 and 64 due to the current flow therethrough compensates for respective potentials at each booster stage, the current flow depending upon the output voltage produced at each of these stages. The voltages V0, V1, V2, V3 and V4 having the potential levels of 0, −2.0, −3.6, −5.3 and −7.3, respectively. In this case, the potential differences between the voltage V2 and each of the voltages V0, V1, V3 and V4 will be 3.6, 1.6, 1.7 and 3.7. In such a case, since the voltage differences between V2 and each of the potentials V0, V1, V3 and V4 are symmetrical, there is almost no DC component so that wasteful power consumption and deterioration of liquid crystals can be prevented. This is particularly advantageous in a case where the liquid crystal display is driven in a matrix mode.

Figure 3:
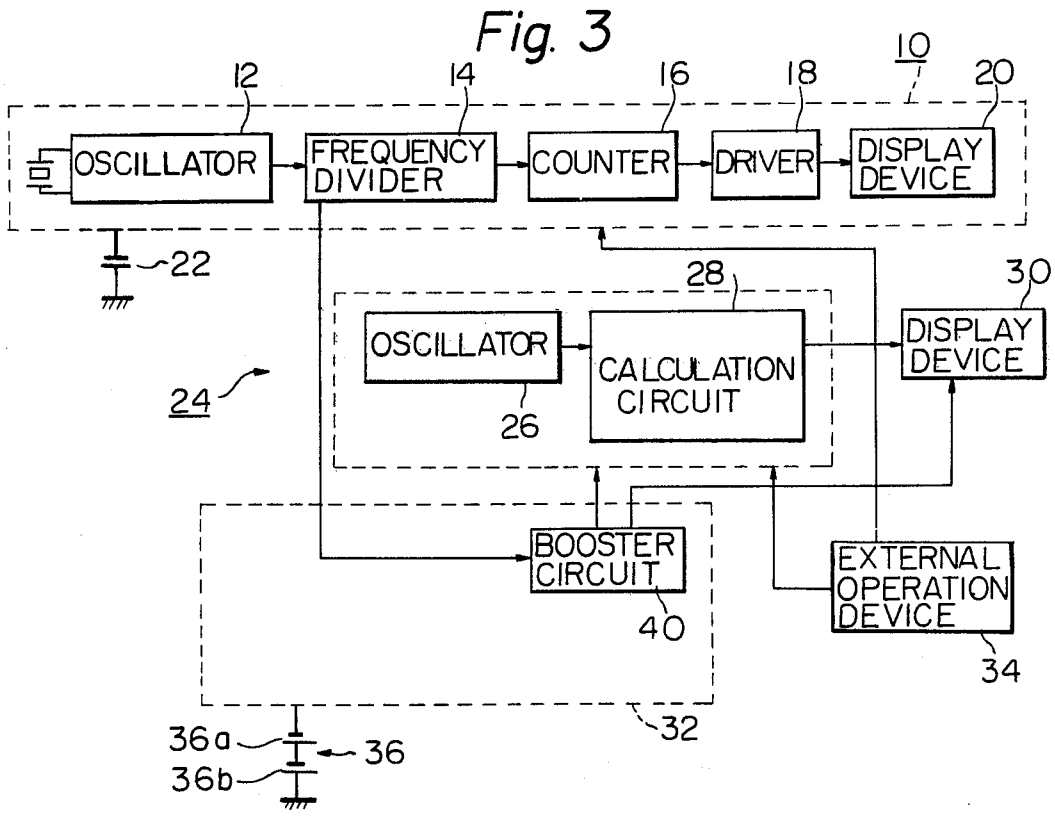
FIG. 3 is a block diagram showing a modification of the booster circuit according to the present invention.

FIG. 3 shows a modification of the wristwatch shown in FIG. 1. In this modification, the oscillator 38 of the calculator section 24 is dispensed with, and an output signal with a frequency of 300 Hz is directly applied from the frequency divider 14 of the timekeeping section 10 to the booster circuit 40.

Figure 4:
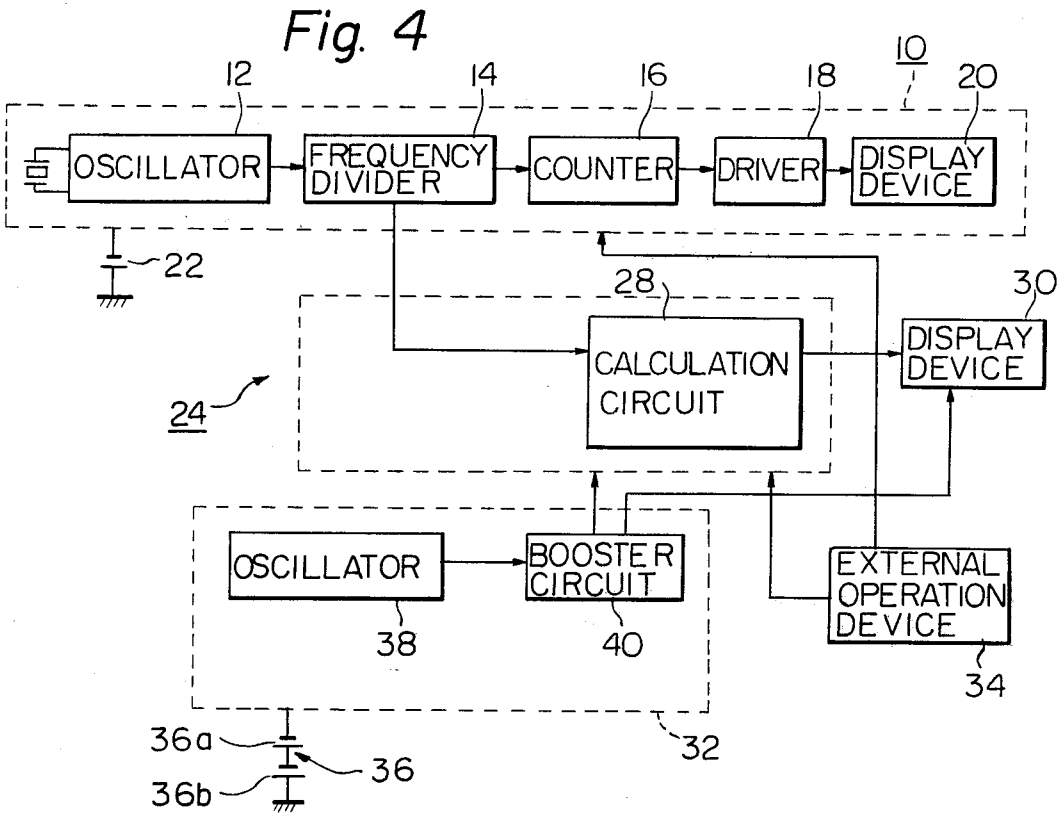
FIG. 4 is similar to FIG. 3 but shows another modification of the booster circuit.

FIG. 4 shows another modification of the electronic calculator wristwatch shown in FIG. 1. In this modification, the oscillator 26 is dispensed with, and the oscillator 12 of the timekeeping section 10 oscillates at a frequency in the order of 4 MHz, and an output signal with a frequency of 300 KHz is directly applied as a clock signal for calculation from the frequency divider 14 to the calculation circuit 28.

Figure 5B:
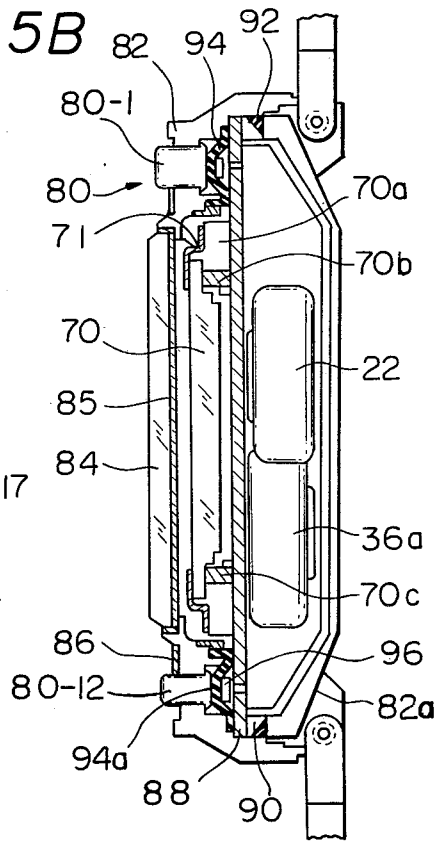
FIG. 5B is a cross sectional view taken on line 5B—5B of FIG. 5A.
Figure 5A:
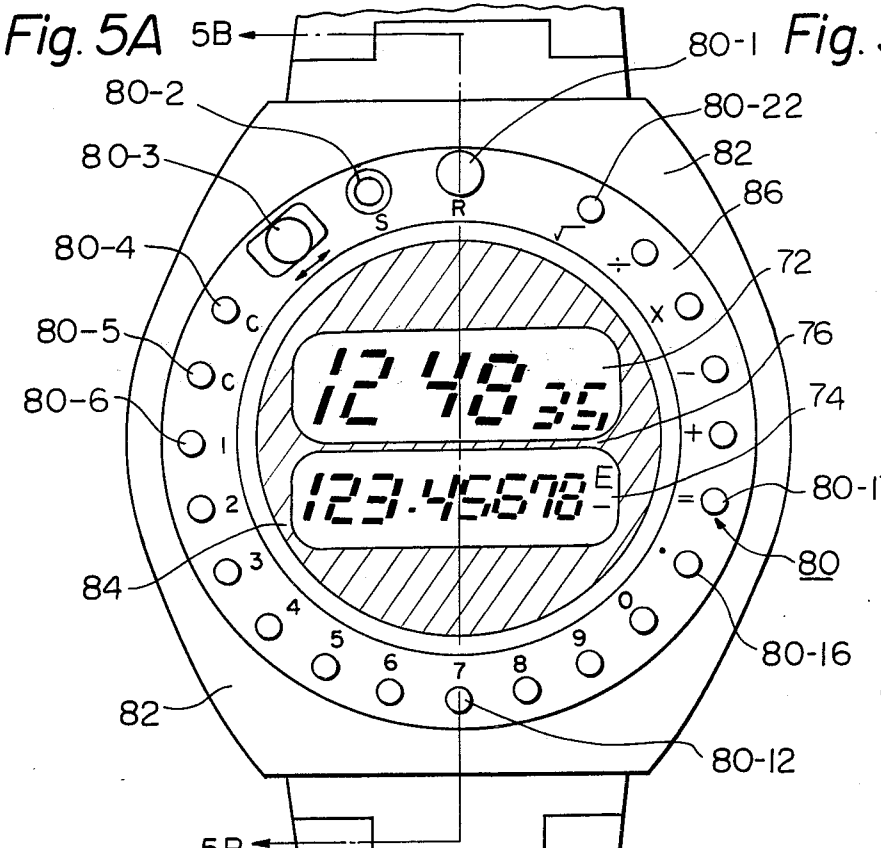
FIG. 5A is a front view of the electronic calculator watch shown in FIG. 1.

FIG. 5(A) is an external view of the wristwatch shown in FIG. 1, and FIG. 5(B) is a cross-sectional view of FIG. 5(A) taken along the line 5B—5B. The display section of the watch makes use of liquid crystal in which a single liquid crystal cell 70 is employed for both the timekeeping and calculation data display. Time display 72 and display section 74 for the calculator are clearly set apart from each other by a partitioning line 76. The time display makes use of a static driving method and the calculator display adopts a matrix driving method. Reference numeral **70*a* denotes a liquid crystal cell frame, and reference numerals 70*b* and 70*c*** designate stacked layers of electrically conductive rubber for the purpose of establishing connections for the liquid crystal cell.

Calculator keys 80 along with push-buttons for the timekeeping functions such as those which are used for a time correction are arranged on the face of the timepiece case 82 and surround the display. R-switch 80-1 is used for switching between a calendar display (month and date) and time display (hours, minutes, seconds), and can also be used to effect time corrections. S-switch 80-2 selects the digit which is to be corrected, and switch 80-3 denotes a power source switch for the calculator section of the wristwatch; the power supply can be turned on and off by sliding the switch in the direction of the arrows. The lower portion of the slide key for the power source switch is elongated in shape and an oblong hole in the case is shielded from view. The upper portion of the key is rounded so as to be more compatible with the other keys. Switch 80-4 denotes an all-clear key, and switch 80-5 a clear-entry key. These keys are usually indicated by CA and CE but have been simplified here to C, c. Switches 80-6 to 80-16 are numeric keys for the calculator, and switches 80-17 to 80-22 are function keys which include addition, subtraction, multiplication, division and square root keys. All of the switches with the exception of switch 80-3 are of the push-button type, and designed so as to be operable without projecting beyond the surface of watchglass 84. Indicated at 85 is a glass support plate. When the keys are disposed along the circumference of the timepiece as shown, the numbers or symbols assigned to each key are placed on the inwardly facing or outwardly facing side of the keys rather than between them in order to avoid the danger of erroneous operation. Furthermore, it is possible to suitably color the heads of the keys or the inscription plate 86 so that the functions of the keys can be distinguished in order to prevent erroneous operation.

Reference numeral 88 denotes a circuit board, 90 a packing seat and 92 packing. The water-proof structure for the key section is composed of key 80, a ring-shaped elastomeric member 94 of rubber or the like serving a water-proofing function, and a projection 94*a* protruding from elastomeric member 94 and corresponding to key 80-12. A piece of electrically conductive rubber 96 is attached to each projection 94*a*. Contacts 80-1*a*, 80-2*a*, and 80-4*a* through 80-22*a* to be described later with respect to FIG. 6 are formed on circuit board 88 in positions corresponding to the pieces of electrically conductive rubber 96.

Figure 6:
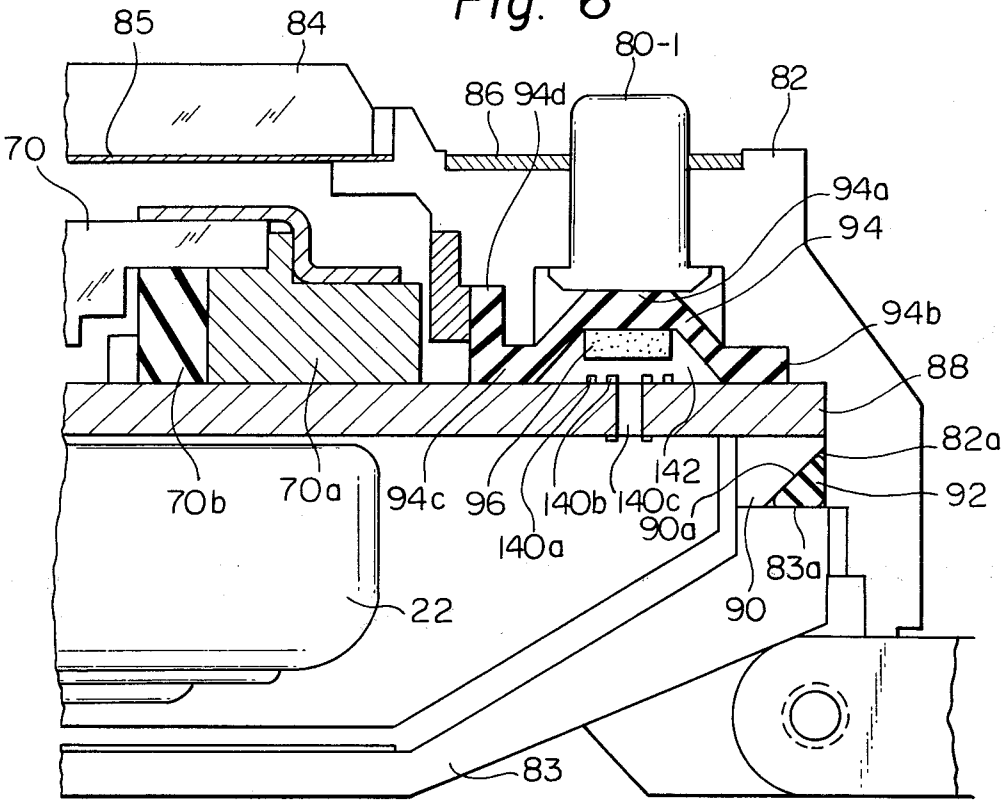
FIG. 6 is an enlarged cross sectional view showing an essential part of the watch shown in FIG. 5B.

FIG. 6 is an enlarged view of the essential portion of FIG. 5B and illustrates a wristwatch arrangement, in accordance with the invention.

A water-proof structure for a key in accordance with the invention will now be described with reference to FIG. 6. The waterproof structure for a key 80-1 includes ring-shaped elastomeric member 94 provided with projection 94*a* having a piece of electrically conductive rubber 96 adhered to the back side of the projection 94*a*. Circuit board 88 is provided with an electrode pattern having contacts 140*a*, 140*b* in opposition to the conductive rubber 96. FIG. 6 shows key 80-1 in the OFF position. However, when the key 80-1 is depressed, elastomeric member 94 is compressed and deformed so that the electrically conductive rubber 96 comes into contact with contacts 140*a*, 140*b* thereby producing a prescribed input signal. When the force depressing key 80-1 is removed, elastomeric member 94 is returned to its original position and the key is once again in the OFF position. According to this structure, circuit board 88 will sustain absolutely no damage even if through some unforseen accident an unneccessarily large force is applied to the key when it is depressed. This feature is made possible by the fact that electrically conductive rubber 96 and elastomeric member 94 are suitably deformable regardless of how the key is manipulated. Moreover, a water-proof structure is obtained by virtue of the fact that elastomeric member 94 is held tightly between case 82 and circuit board 88 at its inner fringes 94*c*, 94*d* and its outer fringe 94*b*. A through-hole 140*c* bored through circuit board 88, in addition to serving as a hole through which an electrical conductor will pass, serves as an air vent which also prevents an increase in air pressure which would otherwise build up in chamber 142 defined between circuit board 88 and projection 94*a* of the elastomeric member. Such an increase in air pressure would be the result of depressing the key. Case 82 and back cover 83 are water-proofed by a structure which incorporates ring-shaped packing seat 90 having slanted wall 90*a*, O-ring 92 and the back cover 83. Water-proofing is assured by O-ring 92 which is compressed by the horizontal surface 83*a* of back cover 83, the inclined surface 90*a* of packing seat 90, and the inner surface 82*a* of case 82. The water-proofing effect along the horizontal surface 83*a* of back cover 83 and along the inner surface 82*a* of case 82 is enhanced by virtue of the inclined surface 90*a* between packing seat 90 and O-ring 92. This structure also allows the outer diameter of the case to be reduced. Circuit board 88 and packing seat 90 are provided with a small hole which engages with a pin (not shown) designed to prevent their mutual rotation; this also serves to position these members once they have been installed within the case. The liquid crystal cell 70, through the intermediary of a piece of connective rubber 70*b*, is resiliently fixed by means of a cell retention spring 71 to a connection terminal on circuit board 88. The circuit board is provided on both sides with a copper foil pattern and is also designed to serve as the base plate of the timepiece while accommodating IC circuits and other electrical compoennts as previously noted. The circuit board is also provided with an insulative coating except at required portions.

Figure 7:
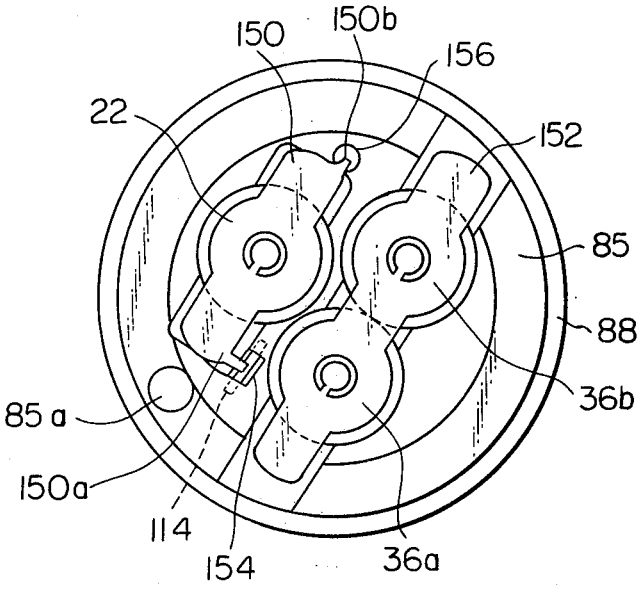
FIG. 7 is a plan view showing batteries and associated parts.

FIG. 7 illustrates the structure of a battery accommodating compartment for the wristwatch shown in FIGS. 5A and 5B. Three batteries are employed as power sources: 22 is a battery exclusively for the timekeeping section while 36*a* and 36*b* are series connected batteries independently provided for the calculator section of the wristwatch. This means that the timekeeping function will be unaffected and that this section of the watch will continue to operate even if the batteries for the calculator section are consumed. The watch is designed such that batteries 22, 36*a*, 36*b* are grounded in the center and surrounded circumferentially by other electrical components in order to make effective use of space and reduce the size of the watch.

Figure 8:
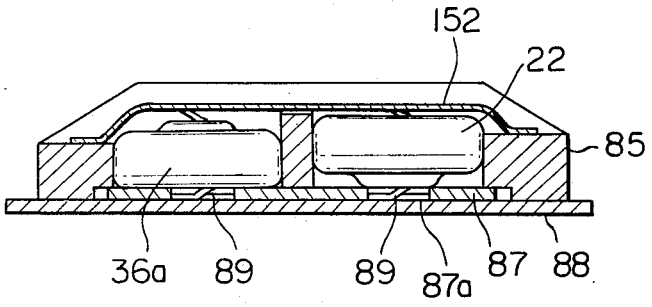
FIG. 8 is a cross sectional view of the watch shown in FIG. 7.

FIG. 8 is a cross-sectional view of the battery accommodating compartment in which reference numeral 85 denotes a device cover which is provided with a hole or recess for covering batteries 22, 36*a*, 36*b* and other electrical components in order to protect them. Device cover 85 is also provided with a through-hole 85*a* corresponding to the location of a trimmer condenser so that the condenser can be manipulated with the cover in place for the purpose of adjusting the frequency, a feature which prevents inadvertant contact with other components. Reference numeral 87 denotes a battery seat made of an insulating sheet and provided with a hole 87*a* corresponding to the position of the battery accommodating compartment. A battery retention spring 89 is fitted into the hole 87*a*. Reference numerals 150, 152 designate battery keep springs. Keep spring 150 for the battery of the timekeeping section is provided with a projection 150*a* for pressuring a portion of a crystal oscillator 114 confined within a recess 154 located within the device cover. Keep spring 150 thus serves as a damper to protect the oscillator from vibrations and impact. The other end 150*b* of keep spring 150 is connected to a ground wire through a hole 156 in device cover 85 in order to ground the oscillator. This structure allows both electrodes of the battery to be resiliently supported so that damage due to instantaneous impact can be prevented.

While the booster circuit of the present invention has been shown and described as being applied to a calculator display section of an electronic calculator watch, it should be noted that the present invention may be applied to any other type of an electronic timepiece with its display device driven in a matrix driving mode.

What is claimed is:

1. In an electronic timepiece having a power supply with first and second terminals and providing a battery voltage potential, and a source of clock pulses, a booster circuit for converting said battery voltage potential to a plurality of boosted output voltages, comprising:

boosting circuit means including a plurality of pairs of boosting diodes connected in series with the first terminal of said power supply and having outputs, respectively, a plurality of first capacitors each having one terminal connected to a junction of one of said pairs of said boosting diodes and another terminal connected to said source of clock pulses, a plurality of second capacitors each having one terminal connected to an input of one of said pairs of boosting diodes and another terminal coupled to the second terminal of said power supply, and a plurality of output leads on which said plurality of boosted output voltages appear, respectively, each of said output leads being connected between an input of one of said pairs of boosting diodes and one of said plurality of second capacitors; and voltage compensating means connected to said second terminal of the power supply and adapted such that the current flow therethrough which is dependent upon said plurality of boosted output voltages produced by said boosting circuit means compensates for an unbalance of said plurality of boosted output voltages applied to said plurality of output leads.

2. In an electronic timepiece according to claim 1, in which said voltage compensating means comprises voltage dropping diodes connected in series with said second terminal of said power supply, and a capacitor connected in parallel with said voltage dropping diodes.

3. In an electronic timepiece, the combination comprising a power supply with first and second terminals and providing a battery voltage potential, a source of clock pulses, and a booster circuit means for converting said battery voltage potential to a plurality of boosted output voltages, said boosting circuit means comprising:

a plurality of pairs of boosting diodes connected in series with the first terminal of said power supply and having outputs, respectively, a plurality of first capacitors each having one terminal connected to a junction of one of said pairs or said boosting diodes and another terminal connected to said source of clock pulses, a plurality of second capacitors each having one terminal connected to an input of one of said pairs of boosting diodes and another terminal coupled to the second terminal of said power supply, and a plurality of output leads on which said plurality of boosted output voltages appear, respectively, each of said output leads being connected between an input of one of said pairs of boosting diodes and one of said plurality of second capacitors; and voltage compensating means connected to said second terminal of the power supply and adapted such that the current flow therethrough which is dependent upon said plurality of boosted output voltages produced by said boosting circuit means compensates for an unbalance of said plurality of boosted output voltages applied to said plurality of output leads;

said source of clock pulses being an oscillator comprising a plurality of series connected inverting amplifiers, including an output inverting amplifier stage having an input side and an output side adapted to produce, amplify and shape a rectangular wave output signal, a variable capacitor connected to the input side of said output inverting amplifier stage and a variable resistor connected with the output side of said output inverting amplifier stage, said variable capacitor and said variable resistor enabling control of the output frequency for potential adjustment of said boosted output voltages.

4. In an electronic timepiece according to claim 3, in which the threshold voltage of said output inverting amplifier stage is selected to be substantially equal to the output voltage of said power supply.

* * * * *